US010329768B2

(12) United States Patent
Verelli et al.

(10) Patent No.: US 10,329,768 B2
(45) Date of Patent: Jun. 25, 2019

(54) SLAB BOLSTER UPPER AND METHOD OF USING THE SAME

(71) Applicants: Angelo Verelli, LaSalle (CA); Carlo Verelli, LaSalle (CA)

(72) Inventors: Angelo Verelli, LaSalle (CA); Carlo Verelli, LaSalle (CA)

( * ) Notice: Subject to any disclaimer, the term of this patent is extended or adjusted under 35 U.S.C. 154(b) by 0 days.

(21) Appl. No.: 15/956,244

(22) Filed: Apr. 18, 2018

(65) Prior Publication Data

US 2018/0298614 A1 Oct. 18, 2018

Related U.S. Application Data

(60) Provisional application No. 62/602,221, filed on Apr. 18, 2017.

(51) Int. Cl.
*E04C 5/16* (2006.01)
*E04C 5/20* (2006.01)
*E01C 11/18* (2006.01)

(52) U.S. Cl.
CPC ..... *E04C 5/20* (2013.01); *E01C 11/18* (2013.01); *E04C 5/168* (2013.01)

(58) Field of Classification Search
CPC ..... E04C 5/20; E04C 5/168; E01C 11/18
See application file for complete search history.

(56) References Cited

U.S. PATENT DOCUMENTS 3,529,392 A * 9/1970 Adams ..... E04C 5/20 52/687
5,664,390 A * 9/1997 Sorkin ..... E04C 5/20 52/677
6,722,097 B2 * 4/2004 Haslem ..... E04C 5/20 52/323
6,735,918 B2 * 5/2004 Haslem ..... E04C 5/20 52/677
6,772,571 B1 * 8/2004 Sorkin ..... E04C 5/20 52/677
6,775,954 B1 * 8/2004 Sorkin ..... E04C 5/167 52/686
6,948,291 B2 * 9/2005 Haslem ..... E04C 5/20 52/371
7,284,354 B1 * 10/2007 Sorkin ..... E04C 5/20 404/134
7,373,764 B1 * 5/2008 Sorkin ..... E04C 5/20 404/134
D600,097 S * 9/2009 Erickson ..... D8/354
D621,239 S * 8/2010 Sorkin ..... D8/354
(Continued)

*Primary Examiner* — Rodney Mintz
(74) *Attorney, Agent, or Firm* — Equinox IP Inc.

(57) ABSTRACT

The present disclosure relates to a slab bolster upper for supporting rebars in a reinforced concrete structure. The slab bolster upper comprises an elongated base defining a lower surface, an upper surface for supporting the rebars, a first edge and a second edge opposite the first edge, voids formed through the elongated base to facilitate free flow of concrete therethrough and around the elongated base, a first connexion integrally formed about the first edge of the elongated base and a second connexion integrally formed about the second edge of the elongated base. The first and second connexions are configured to securely engage with corresponding first and second connexions of adjacent slab bolster uppers for interconnecting a plurality of slab bolster uppers together.

14 Claims, 4 Drawing Sheets

(56) References Cited

U.S. PATENT DOCUMENTS

| | | | | |
|---|---|---|---|---|
| 7,775,010 | B2 * | 8/2010 | Lee | E04C 5/20 24/615 |
| 7,870,703 | B1 * | 1/2011 | Sorkin | E04C 5/18 52/677 |
| 9,121,177 | B1 * | 9/2015 | Sorkin | E04C 5/20 |
| 10,106,985 | B1 * | 10/2018 | Waldner | E04C 5/20 |
| 2003/0009978 | A1 * | 1/2003 | Haslem | E04C 5/20 52/677 |
| 2003/0009979 | A1 * | 1/2003 | Haslem | E04C 5/20 52/677 |
| 2004/0107668 | A1 * | 6/2004 | Haslem | E04C 5/20 52/677 |

* cited by examiner

SLAB BOLSTER UPPER AND METHOD OF USING THE SAME

CROSS-REFERENCE TO RELATED APPLICATIONS

This application claims priority from U.S. Provisional Application No. 62/602,221 filed on Apr. 18, 2017.

TECHNICAL FIELD

The present disclosure relates to slab bolster uppers and to methods of using the same. More particularly, the present disclosure relates to interconnectable slab bolster uppers that can easily be connected one to another for their applications in concrete construction.

BACKGROUND

In reinforced concrete construction, it is necessary to support the reinforcing bars ("rebars") in their designated locations during placement of the concrete and thereafter as it cures. This was accomplished, in its most rudimentary form, by simply resting the rebars on pieces of concrete placed on the surface. Obviously, this approach was unsatisfactory for many reasons, such as the lack of any means for fixing the rebars at their designed positions, as a result of which the rebars were displaced as the concrete was poured.

In response to the shortcomings of this method of supporting rebars, welded wire supports were developed and are used extensively in the reinforced concrete construction industry. With metal supports, however, there is a potential problem of corrosion. Coating the wire with epoxy is a method of dealing with this problem, but coating is expensive, and if the coating is damaged, corrosion may still occur. Such devices further take time to accurately be installed on site, as necessitating external connection means to securely connect reinforcing bars to the welded wire supports, resulting in high concrete construction costs.

However, plastic supports are generally non-corrodible and therefore overcome the problems noted above with welded wire supports, but they usually lack the open construction provided by wire supports that permits full flow of concrete through and around the support during concrete placement. While some patent documents disclose supports that may be formed of plastic and have openings formed in them to facilitate concrete placement, most supports are individual units as opposed to supports that may extend for several spans. Some others provide interconnectable features, however, there is still a need for improved slab bolster uppers that can easily, strongly and securely be connected one to another for their applications in concrete construction.

SUMMARY

It is an object of the present disclosure to provide a slab bolster upper that overcomes or mitigates one or more disadvantages of known slab bolster uppers or at least provides a useful alternative.

According to an embodiment, there is provided a slab bolster upper for supporting a rebar in a reinforced concrete structure, the slab bolster upper comprising:

an elongated base defining a lower surface, an upper surface for supporting the rebar, a first edge and a second edge opposite the first edge;

voids formed through the elongated base to facilitate free flow of concrete therethrough and around the elongated base;

a first connexion integrally formed about the first edge of the elongated base; and a second connexion integrally formed about the second edge of the elongated base; wherein the first connexion is configured to securely engage with a corresponding second connexion of another slab bolster upper and the second connexion is configured to securely engage with a corresponding first connexion of another slab bolster upper for interconnecting a plurality of slab bolster uppers together.

According to another embodiment, there is provided the slab bolster upper defined above, wherein the first connexion comprises a first connexion female connector member outwardly extending from the first edge about the lower surface for engaging with the corresponding second connexion of the other slab bolster upper.

According to a further embodiment, there is provided the slab bolster upper defined above, wherein the first connexion further comprises a first connexion male connector member outwardly extending from the first edge about the upper surface for securely engaging with the corresponding second connexion of the other slab bolster upper.

According to yet another embodiment, there is provided the slab bolster upper defined above, wherein the second connexion comprises a second connexion male connector member outwardly extending from the second edge about the lower surface for securely engaging with a corresponding first connexion female connector member of the corresponding first connexion of the other slab bolster upper.

According to another embodiment, there is provided the slab bolster upper defined above, wherein the second connexion further comprises a second connexion female connector member about the second edge and the upper surface for securely engaging with a corresponding first connexion male connector member of the corresponding first connexion of the other slab bolster upper.

According to a further embodiment, there is provided the slab bolster upper defined above, wherein the first connexion female connector member comprises a lower main portion outwardly extending from the first edge and a longitudinal opening defined within the lower main portion.

According to yet another embodiment, there is provided the slab bolster upper defined above, wherein the elongated base defines a base longitudinal axis substantially parallel to the upper surface and further wherein the longitudinal opening defines an opening plane substantially perpendicular to the base longitudinal axis.

According to another embodiment, there is provided the slab bolster upper defined above, wherein the second connexion male connector member comprises:

a lower structural portion outwardly extending from the second edge; and a lower engaging member upwardly extending from the lower structural portion towards the upper surface of the elongated base when the elongated base is supported by its lower surface for securely engaging the first connexion female connector member while interfacing the longitudinal opening defined within the lower main portion.

According to a further embodiment, there is provided the slab bolster upper defined above, wherein the lower engaging member comprises a lower locking portion at its upper end for locking the second connexion male connector member with the corresponding first connexion female connector member in place once the lower engaging member is passed through the longitudinal opening.

According to yet another embodiment, there is provided the slab bolster upper defined above, wherein the lower locking portion defines:

a concave surface adapted to interface with a lower main portion upper surface for locking the lower engaging member with the corresponding first connexion female connector member; and a convex surface adapted to interface with a longitudinal opening internal surface for facilitating passage of the lower engaging member within the longitudinal opening.

According to another embodiment, there is provided the slab bolster upper defined above, wherein the second connexion female connector member comprises an upper main portion about the second edge and an opening defined within the upper main portion.

According to a further embodiment, there is provided the slab bolster upper defined above, wherein the first connexion male connector member comprises:

an upper structural portion outwardly extending from the first edge; and an upper engaging member outwardly and downwardly extending from the upper structural portion towards the lower surface of the elongated base when the elongated base is supported by its lower surface for engaging within a corresponding opening defined within a corresponding upper main portion.

According to yet another embodiment, there is provided the slab bolster upper defined above, wherein the upper engaging member comprises an upper locking system at its lower end for locking the first connexion male connector member with a corresponding second connexion female connector member in place once the upper engaging member is passed through the opening.

According to another embodiment, there is provided the slab bolster upper defined above, wherein the upper locking system defines a plurality of convex surfaces adapted to interface with an upper main portion lower surface for locking the upper engaging member with the corresponding second connexion female connector member and further adapted to interface with an opening internal surface for facilitating passage of the upper engaging member within the opening.

According to a further embodiment, there is provided the slab bolster upper defined above, wherein the upper structural portion of the first connexion male connector member defines an interfacing surface about the upper engaging member and the upper main portion of the second connexion female connector member defines a supporting surface about the opening for interfacing with and supporting the interfacing surface when the first connexion is fully and securely engaged with the corresponding second connexion of the other slab bolster upper.

According to yet another embodiment, there is provided the slab bolster upper defined above, wherein the upper surface defines an upper longitudinal first side and an upper longitudinal second side opposite the upper longitudinal first side, wherein the lower surface defines a lower longitudinal first side and a lower longitudinal second side opposite the lower longitudinal first side, and further wherein;

the first connexion male connector member extends from the first edge about the upper longitudinal first side for engaging with the corresponding second connexion of the other slab bolster upper;

the first connexion female connector member extends from the first edge about the lower longitudinal second side for engaging with the corresponding second connexion of the other slab bolster upper;

the second connexion male connector member extends from the second edge about the lower longitudinal second side for engaging with the corresponding first connexion of the other slab bolster upper; and the second connexion female connector member is about the second edge and the upper longitudinal first side for engaging with the corresponding first connexion of the other slab bolster upper.

According to another embodiment, there is provided the slab bolster upper defined above, wherein the elongated base comprises:

an elongated member defining a longitudinal surface substantially perpendicular to the upper surface, the elongated member defining the voids; and a plurality of spaced apart transversal members for supporting the elongated member.

According to a further embodiment, there is provided the slab bolster upper defined above, wherein the elongated base further comprises a first longitudinal support member and a second longitudinal support member distant from and parallel to the first longitudinal support member, both the first and second longitudinal support members configured to support the plurality of spaced apart transversal members.

According to yet another embodiment, there is provided the slab bolster upper defined above, wherein each section of the elongated member defined by two adjacent spaced apart transversal members defines two main vertically aligned voids.

According to another embodiment, there is provided the slab bolster upper defined above, wherein the each section of the elongated member defined by two adjacent spaced apart transversal members further defines secondary voids.

BRIEF DESCRIPTION OF THE DRAWINGS

Further features and advantages of the present disclosure will become apparent from the following detailed description, taken in combination with the appended drawings, in which.

DETAILED DESCRIPTION

Figure 1A:
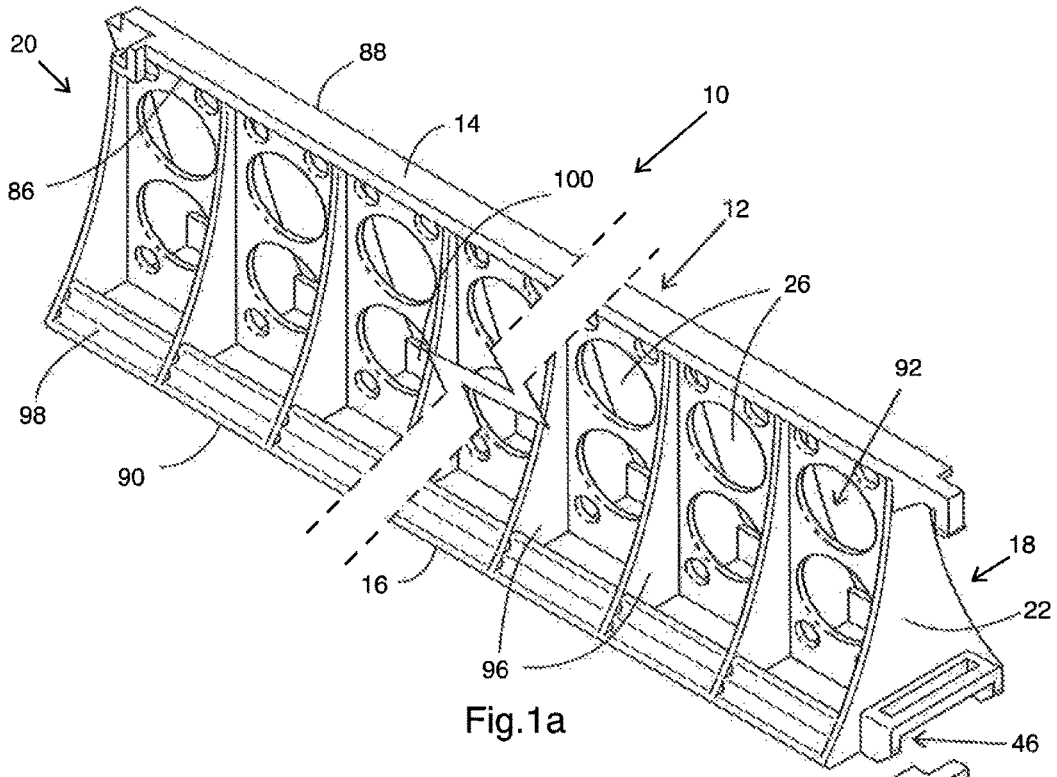
FIG. 1*a* is a perspective view of a slab bolster upper in accordance with an embodiment.
Figure 1B:
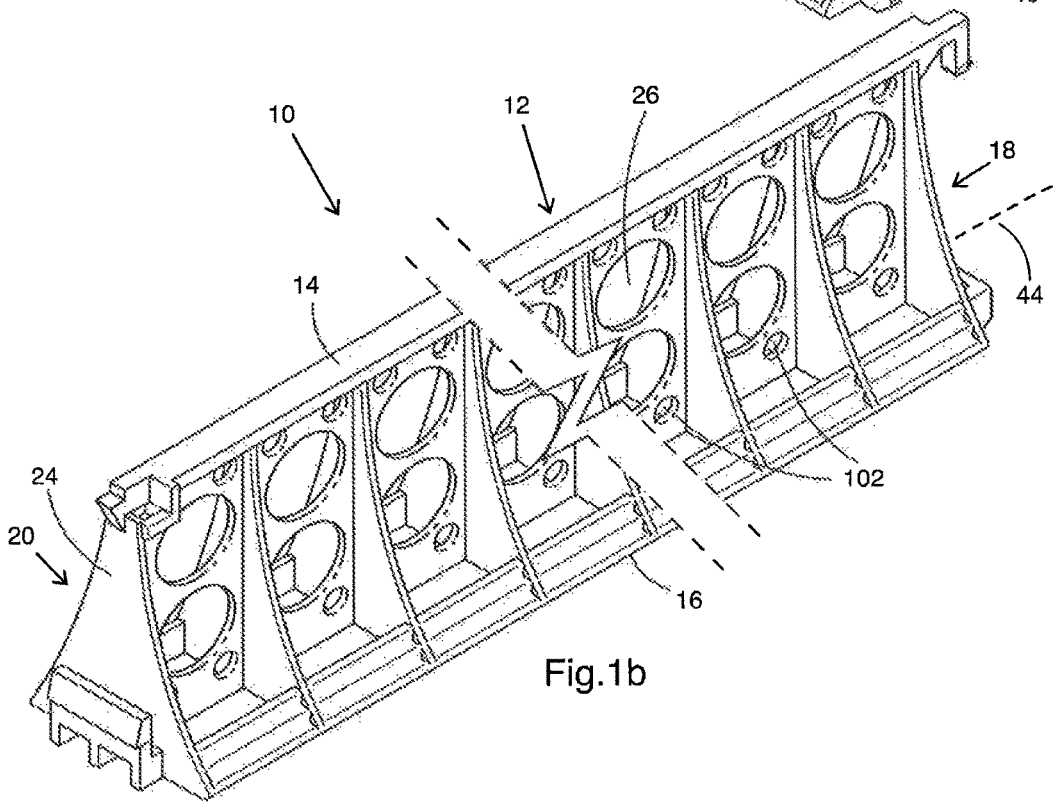
FIG. 1*b* is another perspective view of the slab bolster upper of FIG. 1*a;*
Figure 2:
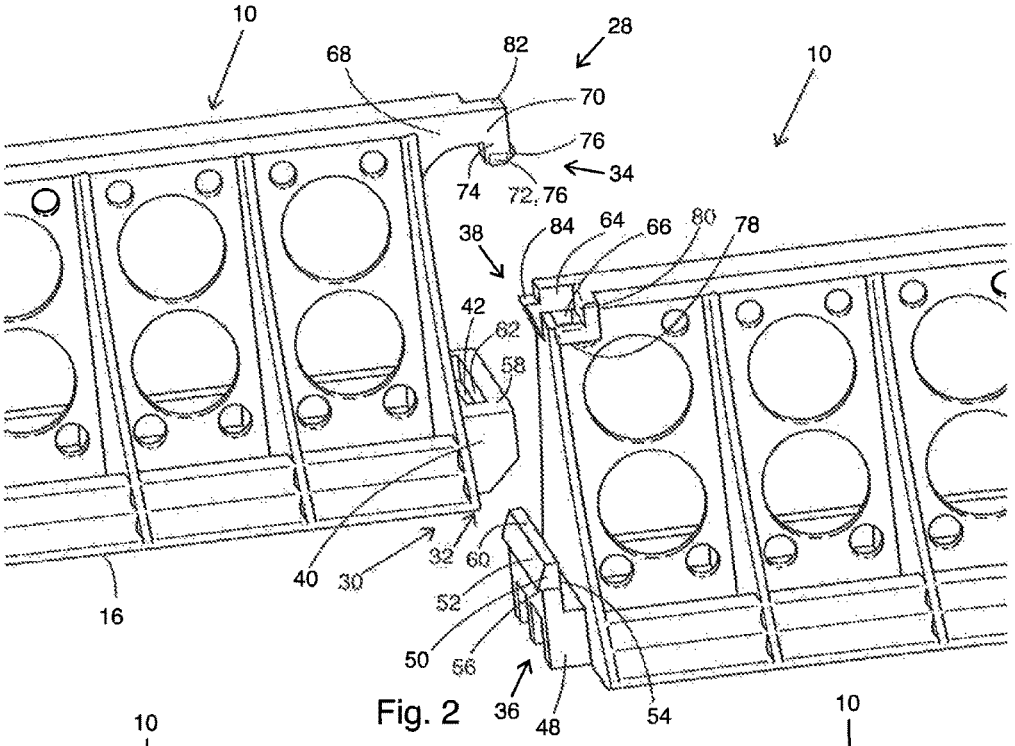
FIG. 2 is a closed-up perspective view of two slab bolster uppers of FIGS. 1*a*/1*b* to be connected together.
Figure 3:
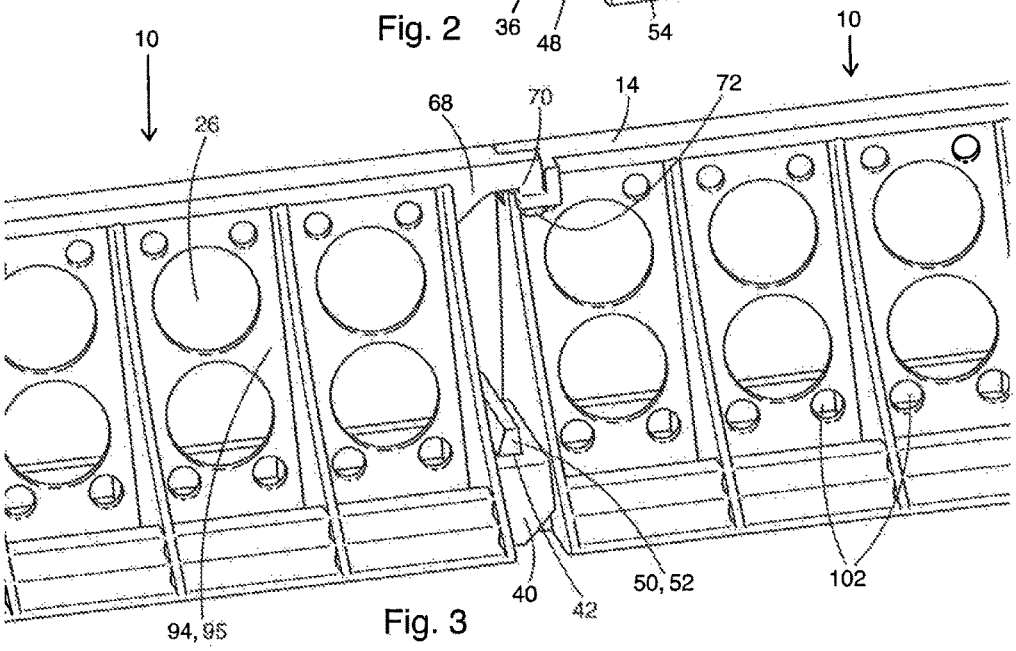
FIG. 3 is a closed-up perspective view of two slab bolster uppers of FIGS. 1*a*/1*b* securely connected one to another via their respective connexions.
Figure 4:
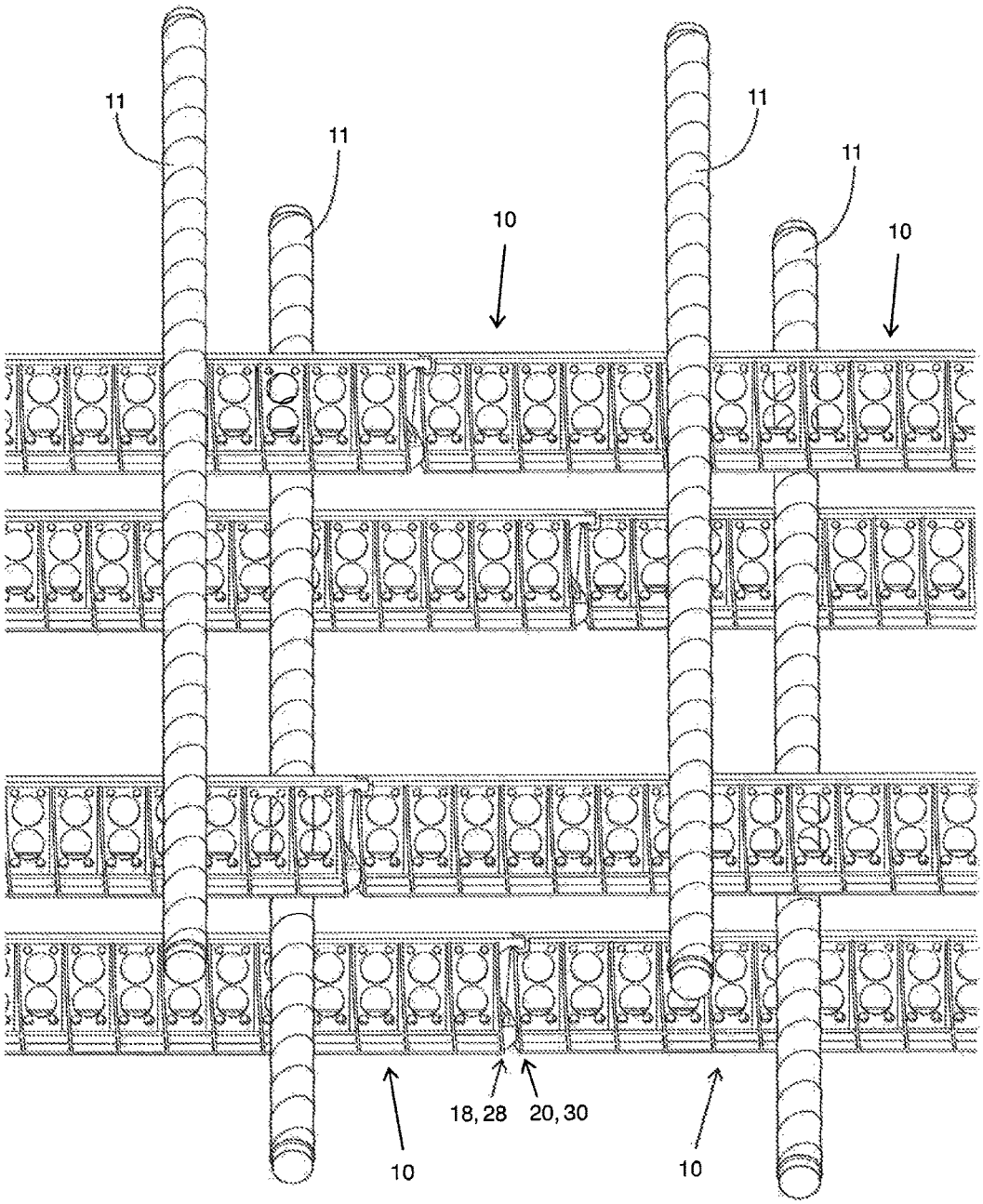
FIG. 4 illustrates slab bolster uppers of FIGS. 1*a*/1*b* that support reinforcing bars (rebars) in a reinforced concrete structure, positioned according to two layers of concrete.

Referring now to the drawings and more particularly to FIGS. 1*a*, 1*b*, 2, 3 and 4, there is shown a slab bolster upper 10 for supporting reinforcing bars 11, the rebars shown in FIG. 4, in a reinforced concrete structure. The slab bolster upper 10 comprises an elongated base 12, which defines a lower surface 16 and an upper surface 14, opposite the lower surface 16, for supporting the rebars 11, as better shown in FIG. 4. The slab bolster upper 10 further defines a first edge 22 and a second edge 24, which is found opposite the first edge 22. It is further shown that elongated base 12 defines a base longitudinal axis 44, which is substantially parallel to upper surface 14. The slab bolster upper 10 further includes a plurality of voids 26 that are formed through the elongated base 12 such as to facilitate free flow of concrete therethrough and around the elongated base 12. Slab bolster upper 10 further includes a first connexion 28, which is integrally formed about the first edge 22 of the elongated base 12 and a second connexion 30, which is also integrally formed about the second edge 24 of the elongated base 12. It is however to be noted that a different construction could include parts that are not integrally formed but that accurately connect two adjacent slab bolster uppers 10 together via their respective first and second connexions 28, 30. Indeed, the first connexion 28 is configured to securely engage with second connexion 30 of an adjacent slab bolster upper 10. Similarly, second connexion 30 is configured to securely engage with first connexion 28 of an adjacent slab bolster upper 10, in a way to securely, easily, quickly and strongly interconnect a plurality of slab bolster uppers 10 together.

As better shown in FIGS. 2 and 3, the first connexion 28 of slab bolster upper 10 comprises a first connexion female connector member 32 which outwardly extends from the first edge 22 (at first end 18) about the lower surface 16 for engaging with second connexion 30 of corresponding/adjacent slab bolster upper 10. The first connexion 28 further comprises a first connexion male connector member 34, which outwardly extends from the first edge 22 about the upper surface 14 for securely engaging with second connexion 30 of corresponding/adjacent slab bolster upper 10.

Still referring to FIGS. 2 and 3, there is shown that second connexion 30 of slab bolster upper 10, on the other hand, comprises a second connexion male connector member 36, which outwardly extends from the second edge 24 about the lower surface 16 for securely engaging with first connexion female connector member 32 of first connexion 28 of the corresponding/adjacent slab bolster upper 10. Second connexion 30 further comprises a second connexion female connector member 38 about the second edge 24 and the upper surface 14 for securely engaging with first connexion male connector member 34 of first connexion 28 of corresponding/adjacent slab bolster upper 10.

First connexion female connector member 32 comprises a lower main portion 40, which outwardly extends from the first edge 22 and a longitudinal opening 42 defined within the lower main portion 40. The longitudinal opening 42 defines an opening plane 46 substantially perpendicular to the base longitudinal axis 44. Second connexion male connector member 36 comprises a lower structural portion 48, which outwardly extends from the second edge 24. Second connexion male connector member 36 further comprises a lower engaging member 50, which upwardly extends from the lower structural portion 48 towards the upper surface 14 of the elongated base 12 when the elongated base 12 is supported by its lower surface 16. Lower engaging member 50 is adapted to securely engage the first connexion female connector member 32 while interfacing the longitudinal opening 42 defined within the lower main portion 40. Lower engaging member 50 comprises a lower locking portion 52 at its upper end 54 for locking the second connexion male connector member 36 with the corresponding first connexion female connector member 32 in place once the lower engaging member 50 is passed through the longitudinal opening 42. Lower locking portion 52 defines a concave surface 56 adapted to interface with a lower main portion upper surface 58 for locking the lower engaging member 50 with the corresponding first connexion female connector member 32 and a convex surface 60 adapted to interface with a longitudinal opening internal surface 62 for facilitating passage of the lower engaging member 50 within the longitudinal opening 42.

Still referring to FIGS. 2 and 3, there is shown that second connexion female connector member 38 comprises an upper main portion 64 about the second edge 24 and an opening 66 defined within the upper main portion 64. First connexion male connector member 34 comprises an upper structural portion 68, which outwardly extends from the first edge 22 and an upper engaging member 70. Upper engaging member 70 outwardly and downwardly extends from the upper structural portion 68 towards the lower surface 16 of the elongated base 12 when the elongated base 12 is supported by its lower surface 16. Upper engaging member 70 is adapted to engage within opening 66 defined within upper main portion 64 of a corresponding/adjacent upper engaging member 70. Upper engaging member 70 comprises an upper locking system 72 at its lower end 74 for locking the first connexion male connector member 34 with second connexion female connector member 38 in place once the upper engaging member 70 is passed through the opening 66. Upper locking system 72 defines a plurality of convex surfaces 76 that are adapted to interface with upper main portion lower surface 78 for locking the upper engaging member 70 with the corresponding second connexion female connector member 38 and further adapted to interface with an opening internal surface 80 for facilitating passage of the upper engaging member 70 within the opening 66.

Still referring to FIGS. 2 and 3, there is shown that upper structural portion 68 of the first connexion male connector member 34 defines an interfacing surface 82 about the upper engaging member 70, while upper main portion 64 of the second connexion female connector member 38 defines a supporting surface 84 about the opening 66. Such supporting surface 84 is adapted for interfacing with and supporting the interfacing surface 82 when the first connexion 28 is fully and securely engaged with the corresponding second connexion 30 of an adjacent slab bolster upper 10.

It is further shown that upper surface 14 defines an upper longitudinal first side 86 and an upper longitudinal second side 88 opposite the upper longitudinal first side 86, while the lower surface 16 defines a lower longitudinal first side 90 and a lower longitudinal second side 92 opposite the lower longitudinal first side 90. Thus, in a way to provide strong and secure connection between to adjacent slab bolster uppers 10 while pouring the concrete, the first connexion male connector member 34 extends from the first edge 22 about the upper longitudinal first side 86 for engaging with second connexion 30, the first connexion female connector member 32 extends from the first edge 22 about the lower longitudinal second side 92 for engaging with the second connexion 30, the second connexion male connector member 36 extends from the second edge 24 about the lower longitudinal second 92 side for engaging with the first connexion 28 and the second connexion female connector member 38 is about the second edge 24 and the upper longitudinal first side 86 for engaging with first connexion 28. Such configuration of the device avoids the first connection 28 to be released from the second connexion 30 when concrete is poured thereon and within the voids 26.

Referring to FIGS. 1*a*, 1*b*, 2 and 3, there is shown that the elongated base 12 comprises an elongated member 94 which defines a longitudinal surface 95 substantially, perpendicular to the upper surface 14. The elongated member 94 defines the voids 26. Elongated member 94 further comprises a plurality of spaced apart transversal members 96 which are adapted to support the elongated member 94. Elongated base 12 further comprises a first longitudinal support member 98 and a second longitudinal support member 100 distant from and parallel to the first longitudinal support member 98. Both the first and second longitudinal support members 98, 100 are configured to support the plurality of spaced apart transversal members 96. According to such embodiment, each section of the elongated member 94 defined by two adjacent spaced apart transversal members 96 defines two main vertically aligned voids 26, while each section of the elongated member 94 defined by two adjacent spaced apart transversal members 96 further defines secondary voids 102 that are positioned to facilitate free flow of concrete therethrough and around the elongated base 12. It is therefore to be noted that positioning of voids 26 and/or secondary voids 102 may differ from the illustrated positioning as long at it provides accurate flow of concrete once poured over the device 10 or the devices 10 itself/themselves.

Slab bolster upper 10 is therefore used for supporting the reinforcing bars, the rebars 10, in a reinforced concrete structure. Indeed, in a scenario where more than one slab bolster uppers 10 are needed, the scenario shown in FIG. 4 for example, a first slab bolster upper 10 is placed on the surface (directly on ground services). About its second connexion 30, the first connexion 28 of a second slab bolster upper 10 is brought closer. For securely connecting the first connexion 28 with the second connexion 30, the first connexion male connector member 34 together with the first connexion female connector member 32 are vertically aligned above their respective second connexion female connector member 38 and second connexion male connector member 36 and downwardly pushed until first connexion male connector member 34 and first connexion female connector member 32 are locked with second connexion female connector member 38 and second connexion male connector member 36. Lower locking portion 52 will provide locking of the lower engaging member 50 with lower main portion 40 once passed through longitudinal opening 42, while upper locking system 72 will provide locking of the upper engaging member 70 with upper main portion 64 once passed through opening 66. Additional slab bolster uppers 10 may be interconnected adjacent the newly formed structure consisting of two connected slab bolster uppers 10. Once all needed slab bolster uppers 10 are positioned on the surface (by their own or connected with adjacent slab bolster uppers 10 as shown in FIG. 4), rebars 11 may be positioned, supported by the slab bolster uppers 10, and concrete may be poured.

Still referring to FIG. 4, there is shown that a first line of slab bolster uppers 10 is positioned directly on the ground services (line of slab bolster uppers 10 shown at bottom of FIG. 4). A third line of slab bolster uppers 10 is further positioned directly on the ground services, distant from first line (3rd line of slab bolster uppers 10 shown from bottom of FIG. 4). Once first and third lines of slab bolster uppers 10 are positioned and well aligned, rebars 11 are placed on devices 10, such as to be supported by upper surfaces 14. Once positioned, rebars 11 are found to be perpendicular to longitudinal axis 44 defined by the slab bolster uppers 10. A first layer of concrete (not shown) is therefore poured onto first and third lines of slab bolster uppers 10 as well as onto rebars 11 that are supported thereon. Where a second layer of concrete is needed, a second line of slab bolster uppers 10 and a fourth line of slab bolster uppers are positioned over the first layer of concrete, sitting on the steel mat (not shown) (see second and fourth lines of slab bolster uppers 10 starting from bottom of FIG. 4). Once second and fourth lines of slab bolster uppers 10 are positioned and well aligned, additional rebars 11 are placed on devices 10, such as to be supported by upper surfaces 14. Once positioned, rebars 11 are also found to be perpendicular to longitudinal axis 44 defined by the slab bolster uppers 10. A second layer of concrete (not shown) is therefore poured onto second and fourth lines of slab bolster uppers 10 as well as onto rebars 11 that are supported thereon.

Figure 5:
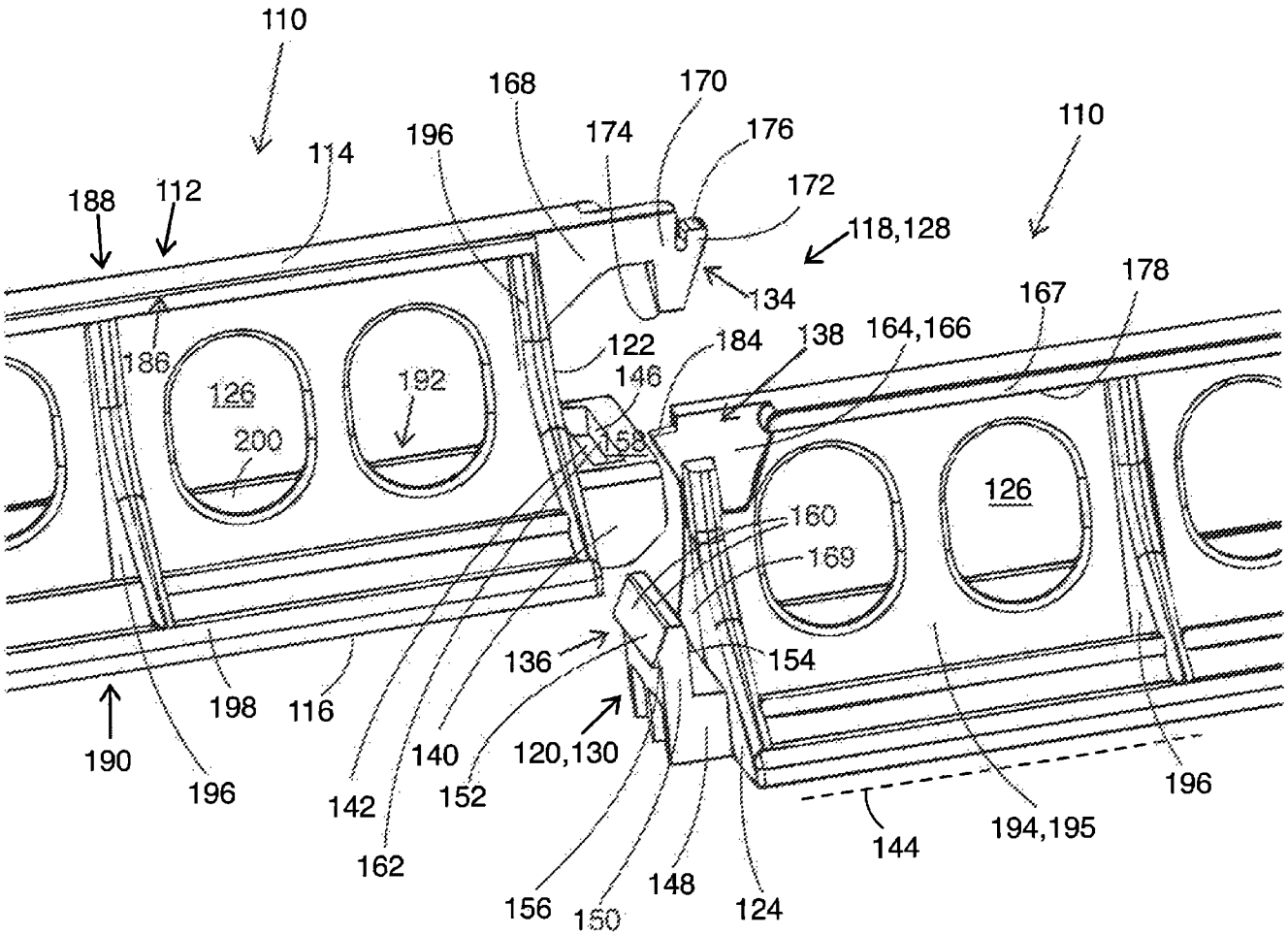
FIG. 5 is a perspective view of slab bolster uppers in accordance with another embodiment to be connected together via their respective connexions.

Referring now more particularly to FIG. 5, there is shown another embodiment of a slab bolster upper 110 that is also for supporting/receiving reinforcing bars 111, the rebars, in a reinforced concrete structure. The slab bolster upper 110 comprises an elongated base 112, which defines a lower surface 116 and an upper surface 114, opposite the lower surface 116, for supporting the rebars. The slab bolster upper 110 further defines a first edge 122 and a second edge 124, which is found opposite the first edge 122. It is further shown that elongated base 112 defines a base longitudinal axis 144, which is substantially parallel to upper surface 114. The slab bolster upper 110 further includes a plurality of voids 126 that are formed through the elongated base 112 such as to facilitate free flow of concrete therethrough and around the elongated base 112. Slab bolster upper 110 further includes a first connexion 128, which is integrally formed about the first edge 122 of the elongated base 112 and a second connexion 130, which is also integrally formed about the second edge 124 of the elongated base 112. It is however to be noted that a different construction could include parts that are not integrally formed but that accurately connect two adjacent slab bolster uppers 110 together via their respective first and second connexions 128, 130. Indeed, the first connexion 128 is configured to securely engage with second connexion 130 of an adjacent slab bolster upper 110. Similarly, second connexion 130 is configured to securely engage with first connexion 128 of an adjacent slab bolster upper 110, in a way to securely, easily and strongly interconnect a plurality of slab bolster uppers 110 together.

First connexion 128 of slab bolster upper 110 comprises a first connexion female connector member 132 which outwardly extends from the first edge 122 (at first end 118) about the lower surface 116 for engaging with second connexion 30 of corresponding/adjacent slab bolster upper 110. The first connexion 128 further comprises a first connexion male connector member 134, which outwardly extends from the first edge 122 about the upper surface 114 for securely engaging with second connexion 130 of corresponding/adjacent slab bolster upper 110.

Second connexion 130 of slab bolster upper 110, on the other hand, comprises a second connexion male connector member 136, which outwardly extends from the second edge 124 about the lower surface 116 for securely engaging with first connexion female connector member 132 of first connexion 128 of the corresponding/adjacent slab bolster upper 110. Second connexion 130 further comprises a second connexion female connector member 138 about the second edge 124 and the upper surface 114 for securely engaging with first connexion male connector member 134 of first connexion 128 of corresponding/adjacent slab bolster upper 110.

First connexion female connector member 132 comprises a lower main portion 140, which outwardly extends from the first edge 122 and a longitudinal opening 142 defined within the lower main portion 140. The longitudinal opening 142 defines an opening plane 146 substantially perpendicular to the base longitudinal axis 144. Second connexion male connector member 136 comprises a lower structural portion 148, which outwardly extends from the second edge 124. Second connexion male connector member 136 further comprises a lower engaging member 150, which upwardly extends from the lower structural portion 148 towards the upper surface 114 of the elongated base 112 when the elongated base 112 is supported by its lower surface 116. Lower engaging member 150 is adapted to securely engage the first connexion female connector member 132 while interfacing the longitudinal opening 142 defined within the lower main portion 140. Lower engaging member 150 comprises a lower locking portion 152 at its upper end 154 for locking the second connexion male connector member 136 with the corresponding first connexion female connector member 132 in place once the lower engaging member 150 is passed through the longitudinal opening 142. Lower locking portion 152 defines a concave surface 156 adapted to interface with a lower main portion upper surface 158 for locking the lower engaging member 150 with the corresponding first connexion female connector member 132 and a convex surface 160 adapted to interface with a longitudinal opening internal surface 162 for facilitating passage of the lower engaging member 150 within the longitudinal opening 142.

Still referring to FIG. 5, there is shown that second connexion female connector member 138 comprises an upper main receiving portion 164 about the second edge 124 and a receiving area 166 defined within the upper main receiving portion 164. A retaining post 169 is further shown. First connexion male connector member 134 comprises an upper structural portion 168, which outwardly extends from the first edge 122 and an upper engaging member 170. Upper engaging member 170 generally outwardly and downwardly extends from the upper structural portion 168 towards the lower surface 116 of the elongated base 112 when the elongated base 112 is supported by its lower surface 116. Upper engaging member 170 is adapted to engage underneath upper surface 114, where a longitudinal lip 167 is formed therein, and defined within upper main receiving portion 164 of a corresponding/adjacent upper engaging member 170. On the other hand, upper structural portion 168 is adapted to be supported by retaining post 169 once upper engaging member 170 is connected with second connexion 130. Indeed, upper engaging member 170 comprises an upwardly extending upper locking system 172, extending from lower end 174, for locking the first connexion male connector member 134 with second connexion female connector member 138 in place once the upper engaging member 170 is pushed underneath longitudinal lip 167. Upwardly extending upper locking system 172 defines an upper convex surface 176 that is adapted to interface with longitudinal lip lower surface 178 for locking the upper engaging member 170 with the corresponding second connexion female connector member 138.

Still referring to FIG. 5, there is shown that upper structural portion 168 of the first connexion male connector member 134 defines an interfacing surface (not shown) about the upper engaging member 170, while upper main receiving portion 164 of the second connexion female connector member 138 defines a supporting surface 184. Such supporting surface 184 is adapted for interfacing with and supporting the interfacing surface (not shown) when the first connexion 128 is fully and securely engaged with the corresponding second connexion 130 of an adjacent slab bolster upper 110. Such configuration of the device avoids the first connection 128 to be released from the second connexion 130 when concrete is poured thereon and within the voids 126.

Elongated base 112 comprises an elongated member 194, which defines a longitudinal surface 195 substantially perpendicular to the upper surface 114. The elongated member 194 defines the voids 126. Elongated member 194 further comprises a plurality of spaced apart transversal members 196 which are adapted to support the elongated member 194. Elongated base 112 further comprises a first longitudinal support member 198 and a second longitudinal support member 200 distant from and parallel to the first longitudinal support member 198. Both the first and second longitudinal support members 198, 200 are configured to support the plurality of spaced apart transversal members 196. According to such embodiment, each section of the elongated member 194 defined by two adjacent spaced apart transversal members 196 defines two main horizontally aligned voids 126.

Slab bolster upper 110 is therefore also used for supporting the reinforcing bars 11 shown in FIG. 4, the rebars 11, in a reinforced concrete structure. Indeed, in a scenario where more than one slab bolster uppers 110 are needed, a first slab bolster upper 110 is placed on the surface (or alternatively on the first layer of concrete as described above). About its second connexion 130, the first connexion 128 of a second slab bolster upper 110 is brought closer. For securely connecting the first connexion 128 with the second connexion 130, the first connexion male connector member 134 together with the first connexion female connector member 132 are vertically aligned above their respective second connexion female connector member 138 and second connexion male connector member 136 and downwardly pushed until first connexion male connector member 134 and first connexion female connector member 132 are locked with second connexion female connector member 138 and second connexion male connector member 136. Lower locking portion 152 will provide locking of the lower engaging member 150 with lower main portion 140 once passed through longitudinal opening 142, while upwardly extending upper locking system 172 will provide locking of the upper engaging member 170 with upper main receiving portion 164 once upwardly extending upper locking system 172 is pushed underneath longitudinal lip 167. Additional slab bolster uppers 110 may be interconnected adjacent the newly formed structure consisting of two connected slab bolster uppers 110. Once all needed slab bolster uppers 110 are positioned on the surface or over the first layer of concrete as shown in FIG. 4 (by their own or connected with adjacent slab bolster uppers 110), rebars 11 may be positioned, supported by the slab bolster uppers 110 on their upper surfaces 114, and concrete may be poured. Designs of slab bolster uppers 10 or 110 and rebars 11 that are different than the one shown in FIG. 4 may also be provided prior pouring first or alternatively second layer of concrete.

The above described slab bolster uppers 10, 110 may be injection molded (or extruded) from a suitable plastic such as polyethylene (i.e., High Density Polyethylene), polycarbonate, polypropylene, and nylon and may be reinforced from various fibers, such as fiberglass, carbon fiber, and metal fibers. The slab bolster uppers 10, 110 may further be constructed in many sizes, shapes and/or configurations, as long as each slab bolster upper 10, 110 provides easy, quick, strong and secure connection with an adjacent one.

It is also to be mentioned that the configuration of the above described slab bolster uppers 10, 110 may facilitate shipment. Indeed, the inverted T or V shape of the slab bolster upper 10 permits it.

In all embodiments described, it is to be noted that voids 26, 126 or secondary voids 102 break up shear planes that would be created in the structure in which the bolster is embedded and contribute to cracking and weakness.

Slab bolster uppers 10, 110 as defined above are therefore, according to their respective configurations, stable and well aligned once interconnected, and further easy to interconnect and to install, thanks to their integrated first and second connexions, their elongated base with voids and their spaced apart transversal members providing structural strength and dimensional stability to the module.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A slab bolster upper for supporting rebars in a reinforced concrete structure, the slab bolster upper comprising:

an elongated base defining a lower supportive surface, an upper surface for supporting the rebars, a first edge and a second edge opposite the first edge, the upper surface being in vertical alignment with the lower supportive surface;

a plurality of discrete voids formed through the elongated base to facilitate free flow of concrete therethrough and around the elongated base;

a first connexion comprising:

a first connexion female connector member outwardly extending from the first edge about the lower supportive surface for locking with a corresponding second connexion male connector member of another slab bolster upper, the first connexion female connector member comprising a lower main portion outwardly extending from the first edge and a longitudinal opening defined within the lower main portion; and a first connexion male connector member outwardly extending from the first edge about the upper surface for engaging with a corresponding second connexion female connector member of the other slab bolster upper; and a second connexion comprising:

a second connexion male connector member outwardly extending from the second edge about the lower supportive surface for locking with a corresponding first connexion female connector member of the other slab bolster upper, the second connexion male connector member comprising a lower structural portion outwardly extending from the second edge and a lower engaging member upwardly extending from the lower structural portion towards the upper surface of the elongated base when the elongated base is supported by the lower supportive surface for securely locking with the first connexion female connector member while interfacing the longitudinal opening defined within the lower main portion; and a second connexion female connector member outwardly extending from the second edge about the upper surface for engaging with a corresponding first connexion male connector member of the other slab bolster upper, the elongated base, the first connexion female connector member, the first connexion male connector member, the second connexion male connector member and the second connexion female connector member being integrally formed;

wherein the first connexion is configured to securely lock with a corresponding second connexion of the other slab bolster upper and the second connexion is configured to securely lock with a corresponding first connexion of the other slab bolster upper for interconnecting a plurality of slab bolster uppers together.

2. The slab bolster upper of claim 1, wherein the elongated base defines a base longitudinal axis substantially parallel to the upper surface and further wherein the longitudinal opening defines an opening plane substantially perpendicular to the base longitudinal axis.

3. The slab bolster upper of claim 1, wherein the upper surface defines an upper longitudinal first side and an upper longitudinal second side opposite the upper longitudinal first side, wherein the lower supportive surface defines a lower longitudinal first side and a lower longitudinal second side opposite the lower longitudinal first side, and further wherein;

the first connexion male connector member extends from the first edge about the upper longitudinal first side for engaging with the corresponding second connexion of the other slab bolster upper;

the first connexion female connector member extends from the first edge about the lower longitudinal second side for engaging with the corresponding second connexion of the other slab bolster upper;

the second connexion male connector member extends from the second edge about the lower longitudinal second side for engaging with the corresponding first connexion of the other slab bolster upper; and the second connexion female connector member is about the second edge and the upper longitudinal first side for engaging with the corresponding first connexion of the other slab bolster upper.

4. The slab bolster upper of claim 1, wherein the lower engaging member defines an upper end and comprises a lower locking portion at the upper end for locking the second connexion male connector member with the corresponding first connexion female connector member in place once the lower engaging member is passed through the longitudinal opening.

5. The slab bolster upper of claim 4, wherein the lower locking portion defines:

a concave surface adapted to interface with a lower main portion upper surface for locking the lower engaging member with the corresponding first connexion female connector member; and a convex surface adapted to interface with a longitudinal opening internal surface for facilitating passage of the lower engaging member within the longitudinal opening.

6. The slab bolster upper of claim 1, wherein the elongated base comprises:

an elongated member defining a longitudinal surface substantially perpendicular to the upper surface, the elongated member defining the voids; and a plurality of spaced apart transversal members for supporting the elongated member.

7. The slab bolster upper of claim 6, wherein the elongated base further comprises a first longitudinal support member and a second longitudinal support member distant from and parallel to the first longitudinal support member, both the first and second longitudinal support members configured to support the plurality of spaced apart transversal members.

8. The slab bolster upper of claim 6, wherein each section of the elongated member defined by two adjacent spaced apart transversal members defines two main vertically aligned voids.

9. The slab bolster upper of claim 8, wherein the each section of the elongated member defined by two adjacent spaced apart transversal members further defines secondary voids.

10. The slab bolster upper of claim 1, wherein the second connexion female connector member comprises an upper main portion about the second edge and an opening defined within the upper main portion.

11. The slab bolster upper of claim 10, wherein the first connexion male connector member comprises:

an upper structural portion outwardly extending from the first edge; and an upper engaging member outwardly and downwardly extending from the upper structural portion towards the lower supportive surface of the elongated base when the elongated base is supported by the lower supportive surface for engaging within a corresponding opening defined within a corresponding upper main portion.

12. The slab bolster upper of claim 11, wherein the upper engaging member defines a lower end and comprises an upper locking system at the lower end for locking the first connexion male connector member with the corresponding second connexion female connector member in place once the upper engaging member is passed through the opening.

13. The slab bolster upper of claim 12, wherein the upper locking system defines a plurality of convex surfaces adapted to interface with an upper main portion lower surface for locking the upper engaging member with the corresponding second connexion female connector member and further adapted to interface with an opening internal surface for facilitating passage of the upper engaging member within the opening.

14. The slab bolster upper of claim 13, wherein the upper structural portion of the first connexion male connector member defines an interfacing surface about the upper engaging member and the upper main portion of the second connexion female connector member defines a supporting surface about the opening for interfacing with and supporting the interfacing surface when the first connexion is fully and securely engaged with the corresponding second connexion of the other slab bolster upper.

* * * * *